US007828499B2

(12) United States Patent
Carpenter

(10) Patent No.: US 7,828,499 B2
(45) **Date of Patent: *Nov. 9, 2010**

(54) EROSION CONTROL SYSTEM

(75) Inventor: Thomas J. Carpenter, Ankeny, IA (US)

(73) Assignee: Erosion Tech, LLC, Ankeny, IA (US)

( * ) Notice: Subject to any disclaimer, the term of this patent is extended or adjusted under 35 U.S.C. 154(b) by 256 days.

This patent is subject to a terminal disclaimer.

(21) Appl. No.: 11/827,639

(22) Filed: Jul. 12, 2007

(65) Prior Publication Data

US 2009/0016826 A1 Jan. 15, 2009

(51) Int. Cl.
*E02B 3/12* (2006.01)

(52) U.S. Cl. ..... 405/302.6; 405/302.7; 405/16; 405/17

(58) Field of Classification Search ..... 405/15, 405/16, 17, 19, 20, 258.1, 259.1, 302.4, 302.6, 405/302.7; 404/36
See application file for complete search history.

(56) References Cited

U.S. PATENT DOCUMENTS

| | | | | |
|---|---|---|---|---|
| 360,225 | A | 3/1887 | Kanters | |
| 1,092,203 | A | 4/1914 | Carter | |
| 3,139,163 | A | 6/1964 | Haller | |
| 3,570,254 | A | 3/1971 | Turzillo | |
| 4,003,169 | A | 1/1977 | Young | |
| 4,054,267 | A | 10/1977 | Berg | |
| 4,243,350 | A | 1/1981 | Hall | |
| 4,596,731 | A | 6/1986 | Cudmore et al. | |
| 4,610,568 | A * | 9/1986 | Koerner | 405/302.6 |
| 4,611,446 | A * | 9/1986 | Beavers et al. | 405/259.1 |
| 4,727,693 | A * | 3/1988 | Rockenfeller et al. | 52/163 |
| 4,802,317 | A | 2/1989 | Chandler | |
| 4,936,194 | A | 6/1990 | Horowitz | |
| 5,020,938 | A * | 6/1991 | Scales | 405/16 |
| 5,031,370 | A | 7/1991 | Jewett | |
| 5,058,337 | A | 10/1991 | O'Connor | |
| 5,171,108 | A * | 12/1992 | Hugron | 405/259.1 |
| 5,175,966 | A | 1/1993 | Remke | |
| 5,256,007 | A * | 10/1993 | Allen | 405/302.4 |
| 5,358,356 | A | 10/1994 | Romanek et al. | |
| 5,364,206 | A | 11/1994 | Marienfeld | |
| 5,428,935 | A | 7/1995 | Mitchell | |
| 5,476,339 | A | 12/1995 | Baranowski | |
| 5,484,230 | A * | 1/1996 | Rudloff | 405/20 |
| 5,584,600 | A * | 12/1996 | Langdon | 405/16 |
| 5,651,641 | A | 7/1997 | Stephens et al. | |
| 5,775,037 | A | 7/1998 | James | |
| 5,820,294 | A | 10/1998 | Baranowski | |

(Continued)

OTHER PUBLICATIONS

Georunner Surface Protection System, two page brochure.

(Continued)

*Primary Examiner*—Frederick L Lagman
(74) *Attorney, Agent, or Firm*—Shook, Hardy & Bacon L.L.P.

(57) ABSTRACT

An erosion control system for reducing erosion under effluent flow conditions. The system includes an erosion control mat anchored over an erosion susceptible area. The anchoring system uses an anchor positioned below the soil, connected to the mat by a flexible strap. Due to its high shear resistance, the system may be used in high effluent flow areas, such as drainage ditches and creeks.

20 Claims, 7 Drawing Sheets

U.S. PATENT DOCUMENTS

| | | | | |
|---|---|---|---|---|
| 5,833,400 | A | 11/1998 | Wamsher | |
| 5,881,506 | A | 3/1999 | Chapman | |
| 5,951,202 | A | 9/1999 | Brown | |
| 6,027,285 | A | 2/2000 | Angel | |
| 6,171,022 | B1 * | 1/2001 | Decker | 405/16 |
| 6,237,289 | B1 | 5/2001 | Jewett | |
| 6,370,827 | B2 | 4/2002 | Chalich | |
| 6,401,408 | B1 | 6/2002 | Schwartz et al. | |
| 6,461,084 | B1 | 10/2002 | Stuart | |
| 6,474,028 | B2 | 11/2002 | Cusimano | |
| 6,527,407 | B2 * | 3/2003 | Gluck | 362/153.1 |
| 6,558,074 | B2 * | 5/2003 | Jansson | 405/16 |
| 6,572,308 | B1 | 6/2003 | Busto | |
| 6,579,038 | B1 * | 6/2003 | McAllister et al. | 405/16 |
| 6,592,292 | B1 * | 7/2003 | Jansson | 405/20 |
| 6,612,776 | B1 * | 9/2003 | Jansson | 405/20 |
| 6,824,331 | B2 | 11/2004 | Parker | |
| 6,835,027 | B1 | 12/2004 | Glass | |
| 6,863,472 | B2 | 3/2005 | Jansson | |
| 6,942,421 | B2 * | 9/2005 | Jansson | 405/20 |
| 6,951,438 | B2 | 10/2005 | Carpenter | |
| 7,033,109 | B2 | 4/2006 | Russell | |
| 7,083,358 | B2 * | 8/2006 | Grosjean | 405/16 |
| 2001/0045068 | A1 | 11/2001 | Chalich | |
| 2003/0017000 | A1 * | 1/2003 | Jansson | 405/16 |
| 2003/0019080 | A1 | 1/2003 | Anthony et al. | |
| 2003/0022134 | A1 | 1/2003 | Seniuk | |
| 2003/0082015 | A1 | 5/2003 | Christensen | |
| 2003/0228192 | A1 * | 12/2003 | Jansson | 405/16 |
| 2004/0013467 | A1 * | 1/2004 | Jansson | 405/18 |
| 2005/0078475 | A1 * | 4/2005 | Byers et al. | 362/153.1 |

OTHER PUBLICATIONS

Final OA mailed Sep. 8, 2009, U.S. Appl. No. 11/500,811.

Non-final OA mailed Nov. 24, 2009, U.S. Appl. No 11/500,811.

Non-final OA mailed Dec. 5, 2008, U.S. Appl. No. 11/500,811.

Non-final OA mailed Jan. 8, 2009, U.S. Appl. No. 12/214,346.

Non-final OA mailed Aug. 6, 2009, U.S. Appl. No. 12/214,346.

Notice of Allowance mailed Dec. 1, 2009, U.S. Appl. No. 12/214,346.

Final Office Action, U.S. Appl. No. 11/500,811, Filing Date: Aug. 8, 2006, Mail Date: Jun. 8, 2010, 8 pages.

Notice of Allowance and Fee(s) Due; Date Mailed: Jun. 11, 2010; Title of Invention: Erosion Control System; U.S. Appl. No. 11/827,639; filing Date: Jul. 12, 2007.

* cited by examiner

EROSION CONTROL SYSTEM

BACKGROUND OF THE INVENTION

1. Field of the Invention

The present invention relates in general to an erosion control system for reducing erosion and, more particularly, to a system for reducing erosion of erosion susceptible areas in flowing effluent environments.

2. Description of the Prior Art

The Clean Water Act and subsequent legislation requires storm water to be discharged in a non-erosive manner. Unfortunately, storm water pipe outlets and the like used to divert water runoff are highly erosive at their outlets as the result of velocity and shear force problems associated with the funneling of water toward a narrow outlet. Erosion control associated with such Outlets involves economic, physical and logistical problems. Traditionally, storm water is transported from a street or parking lot in a storm water pipe to a conveyance, such as a stream or river. Storm water may also be drained from a permanent structure, like a parking lot, at designated outlets where it flows overland and naturally dissipates. The soil area adjacent such discharge points is highly susceptible to severe erosion associated with discharging water.

The energy of water discharging from such outlets varies with the velocity, shear force and volume of the effluent. Water 25 centimeters deep, flowing rapidly, is much more erosive and destructive than water 8 centimeters deep, flowing at the same rate. Accordingly, allowing runoff water to spread out is an effective means to counteract funneling of discharge water, dissipating both velocity and shear force without mechanical input. Conversely, squeezing water raises its height and increases its hydraulic pressure. This increase in hydraulic pressure results in increased shear force which, in turn, leads to increased erosion. Unfortunately, the factors associated with diverting water, namely collecting water from a relatively large area and funneling it to a very small area, using hard, smooth surfaces, cannot help but magnify the weight, velocity and shear force of the water at the discharge point.

Traditionally, at such discharge points, material, such as rip rap, is added. Such installation of various sized rocks, stacked in a concave manner to funnel water, may be used to reduce erosion, but is very expensive and time consuming to install. Alternatively, concrete blankets (flat soft material filled with concrete or concrete blocks held together with steel cables), or concrete slabs may be used to control erosion at discharge points. These products, and other similar products, are referred to as "hard armor." Hard armor often dissipates water energy and protects the soil therebeneath from eroding away and polluting natural resources. One drawback associated with hard armor is the requirement of very large equipment needed to install the hard armor. Additionally, a significant volume of material must be freighted to the site and a large amount of preparatory work is required before installing the hard armor.

While hard armor is useful for dissipating velocity and countering shear forces associated with runoff water, poor installation often allows the water to splash or divert out of the designated channel, many times leading to the erosion and washout of the hard armor installation itself. While concrete blankets are better able to withstand velocity and shear forces, they do little to inhibit the velocity and, therefore, the destructive force of water runoff. Another drawback associated with hard armor is that it typically lacks aesthetics associated with other forms of erosion control.

Recently, the industry has developed blanket-type products called turf reinforcement mats to convey water and withstand designated loads. While such turf reinforcement mats do little to reduce or mechanically dissipate the energy of runoff water energy themselves, their installation allows for the growth of vegetation which, in turn, mechanically reduces energy associated with runoff water. Such blankets are typically three-dimensional, flexible mats constructed of plastic webbing. The open weave of such mats allows vegetation to grow up therethrough. The combination of the mechanical stable structure and open weave design results in a significant synergistic effect, with the capacity to carry much greater velocity and sheet force load because roots and stems associated with the upgrowing vegetation are reinforced by the mat.

It is also known in the art to provide an erosion control mat as described in U.S. Letters Pat. No. 6,951,438 to reduce erosion. The erosion control mat is more rigid than turf reinforcement mats. Unlike hard armor, the erosion control mats allow for vegetative growth therethrough. Although turf reinforcement mats and erosion control mats have numerous advantages over the prior art in terms of reducing erosion, it is often difficult to securely mount these types of mats in an erosion susceptible area. While the mats may obviously be secured into concrete blankets, if it is desired to secure the mats directly to the soil, complex and expensive anchoring systems requiring specialized tools and multiple installers are typically required. One method of installation involves securing a pivoting anchor to a cable and driving the anchor and cable through the mat into the soil. The cable is then lifted upward to pivot and lock the anchor. One installer thereafter pulls upward on the cable, while a second installer swages a bead to the cable to prevent the mat from becoming dislodged from the ground. Although this system works reasonably well for securing mats to the ground, the system involves several drawbacks.

First, the system typically requires multiple installers, one to generate sufficient upward force to eliminate any slack in the cable, while a second installer crimps the bead to the cable. Another drawback associated with the prior art is that the system typically involves a complex securement of the cable to the anchor. This requires the anchor to be associated with a predetermined length of cable, which must be cut to size with the remainder discarded. This leads to undesired waste and severely limits the use of the system in areas where a securement lower than the predetermined length of the cable is desired.

Another drawback associated with prior art is the lack of resiliency associated with the cable. Even using multiple installers, the system typically does not provide significant bias of the mat into the ground. As the installation system typically results in at least a small amount of "play" between the mat and the ground, effluent can often move underneath the mat, causing undesired erosion and additional play between the mat and the ground. Play is a particular problem in continuous water flow environments, such as creek beds and large flow and pressure environments such as drainage ditches. If the play becomes substantial enough, the anchor can become dislodged, allowing the mat to move away from the erosion susceptible surface, thereby defeating the purpose of the mat.

Another drawback associated with the prior art is the weight of the prior art anchoring systems. While the weight of one anchor system is of only marginal consequence, the cost of transporting and moving a large number of anchors makes the use of heavy anchors and cables undesirable. Still another drawback associated with the prior art is the difficulty in removing the anchor system if it is desired to remove the mat.

Typically, removal requires multiple installers with the first installer pulling upward on the bead sufficiently to allow the second installer to move bolt cutters between the bead and the mat. The difficulties encountered in the prior art discussed hereinabove are substantially eliminated by the present invention.

SUMMARY OF THE INVENTION

In an advantage provided by this invention, an erosion control system is provided which is of a lightweight, low cost manufacture.

Advantageously, this invention provides an erosion control system which is easy to install.

Advantageously, this invention provides an erosion control system which is easy to remove.

Advantageously, this invention provides an erosion control system which is adjustable to accommodate anchoring at various depths.

Advantageously, this invention provides an erosion control system which biases an erosion control mat toward the ground.

Advantageously, this invention provides an erosion control system which allows for quick installation without heavy or costly tools.

Advantageously, this invention provides a rigid erosion control system which allows greater securement with fewer securement points.

Advantageously, this invention provides for maintaining an erosion control surface in intimate contact with an erosion susceptible area.

Advantageously, in a preferred example of this invention, an erosion control system is provided. The erosion control system includes a surface defining a plurality of holes and means for securing the surface over an erosion susceptible area against a fluid flow of at least two meter's per second. The surface preferably weighs less than one hundred kilograms. In the preferred embodiment, the surface weighs less than ten kilograms and is secured to soil using an anchor system, positioning an anchor at least five centimeters below the surface of the soil and secured to the surface by a flexible line. The surface may be used in high flow effluent areas, such as drainage ditches and creeks to prevent erosion.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
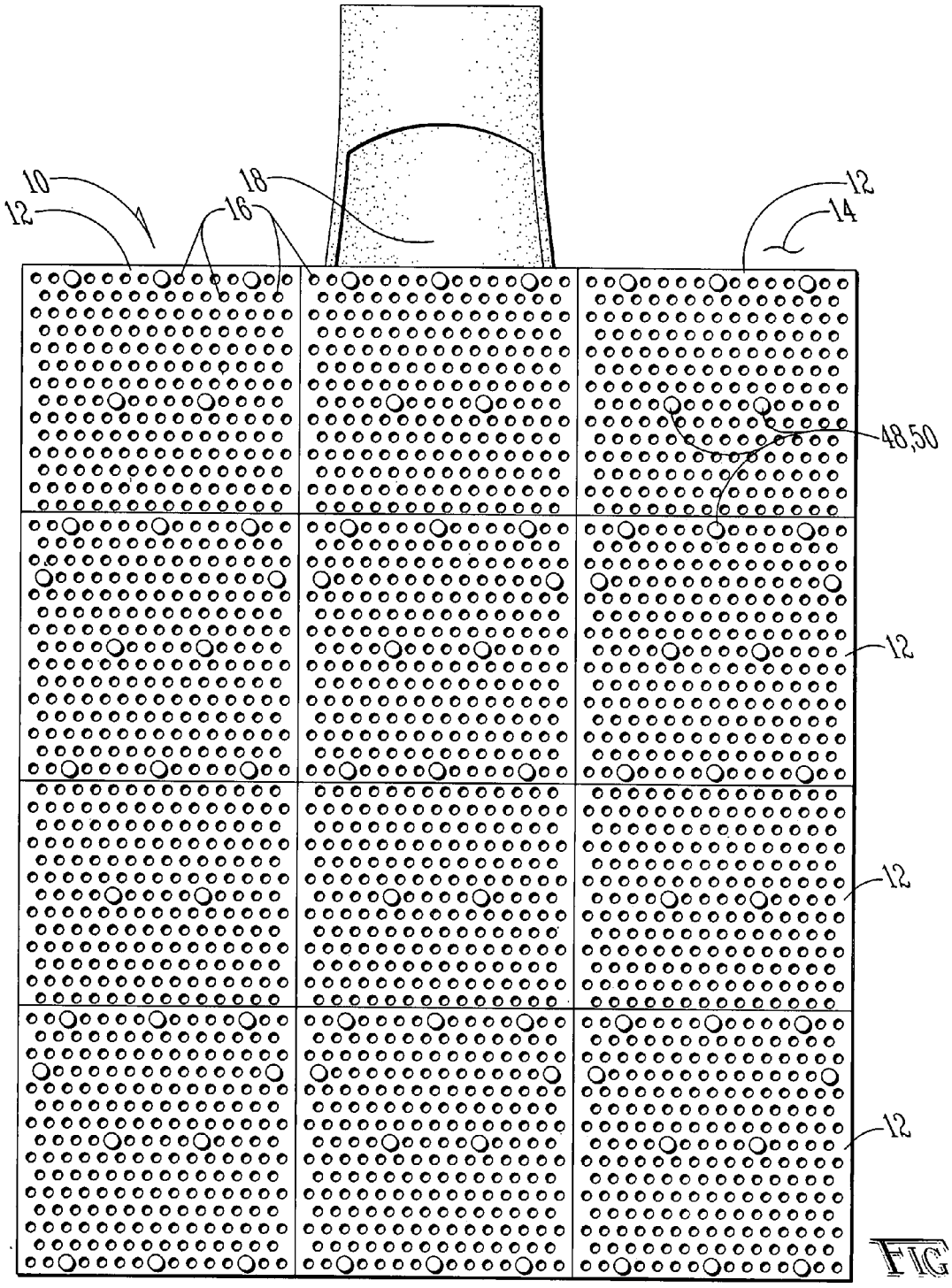
FIG. 1 illustrates a top plan view of a plurality of erosion control mats secured in place by the anchor system of the present invention at the outlet of an effluent discharge.

An erosion control system according to this invention is shown generally as (10) in FIG. 1. A plurality of the systems (10) are shown securing a plurality of erosion control mats (12), such as those described in U.S. Letters Pat. No. 6,951,438, which is incorporated herein by this reference. The system (10) may, of course, be used in association with any type of erosion control surface, such as plastic sheeting, canvas, sod, a turf reinforcement mat, or any other erosion control surface. As shown, the anchor system (10) of the present invention is used to secure the erosion control mats (12) in an overlapped relationship. The erosion control mat (12) may be constructed in any desired configuration, but is preferably rigid once constructed. In the preferred embodiment, a two meter long and one meter wide section of the material used to construct the erosion control mat (12) deflects less than forty-five degrees when supported by one end. The erosion control mat (12) is provided with holes (16) having a diameter of preferably less than ten centimeters and, more preferably, less than five centimeters. The erosion control mat (12) is less than one hundred square meters, preferably less than five square meters and, most preferably about one square meter in area. The erosion control mat (12) weighs less than one hundred kilograms, preferably less than ten kilograms and, most preferably, about five kilograms. The erosion control mat (12) weighs preferably at least three kilograms.

The anchor systems (10) provided at the upstream and downstream portions of the erosion control mats (12) extend through two erosion control mats (12) tying them together, as well as securing them over the erosion susceptible surface (14), such as dirt, sod or secondary erosion control surface such as a turf reinforcement mat or the like. As shown in FIG. 1, the anchor system (10) extends through one of the holes (16) provided in the erosion control mats (12). The erosion control mat (12) can be secured in a non-overlapping, or any desired configuration. Similarly, any desired erosion control surface may be used instead of an erosion control mat (12). As shown, the erosion control mats (12) are provided at the mouth of an effluent discharge (18) which, in the preferred embodiment, is a concrete slab but may, of course, be any type of hard armor or any other type of effluent discharge known in the art.

Figure 2A:
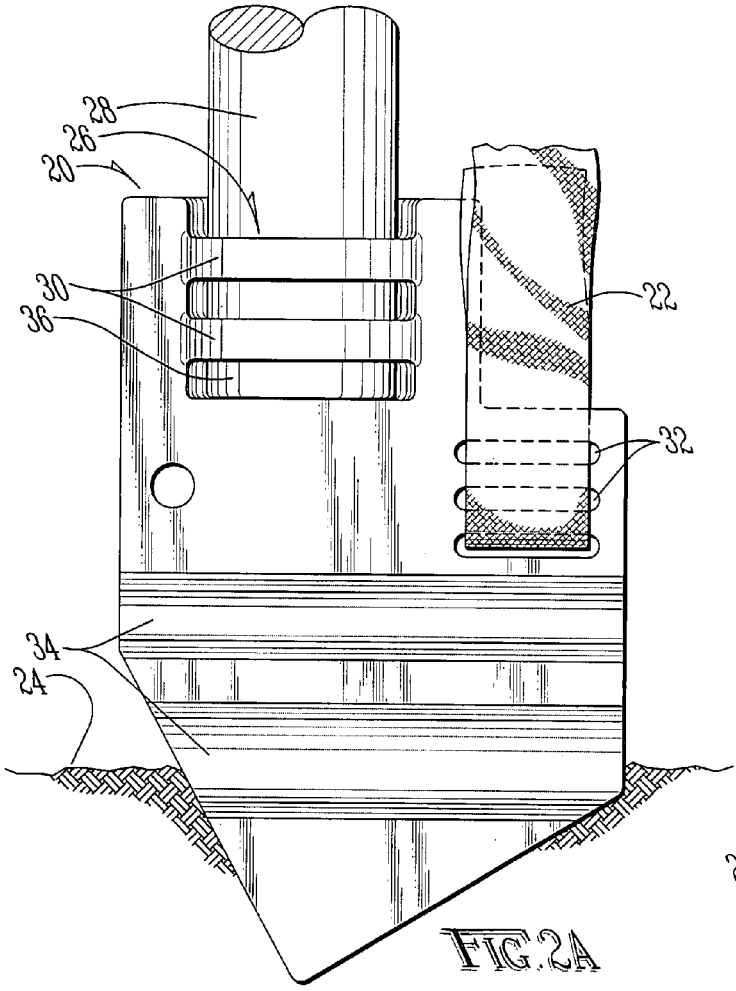
FIG. 2 illustrates a top perspective view showing the driving rod being positioned into the anchor for securement below ground.
Figure 2B:
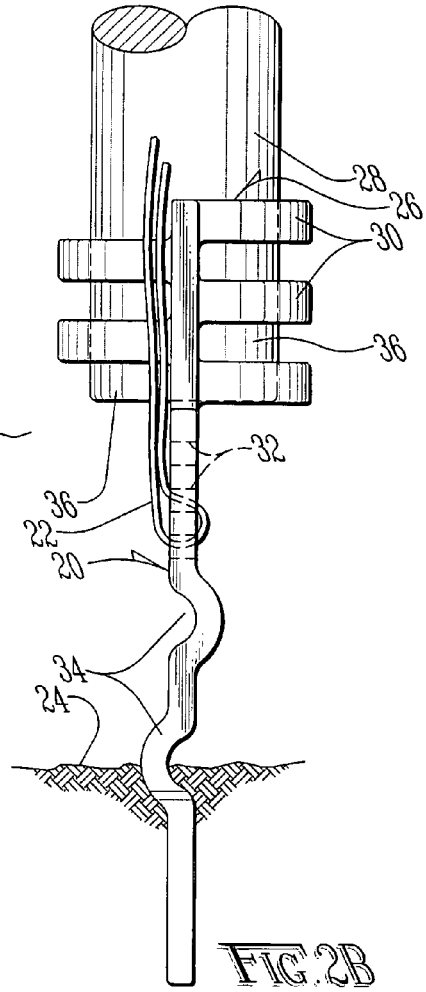
Figure 3:
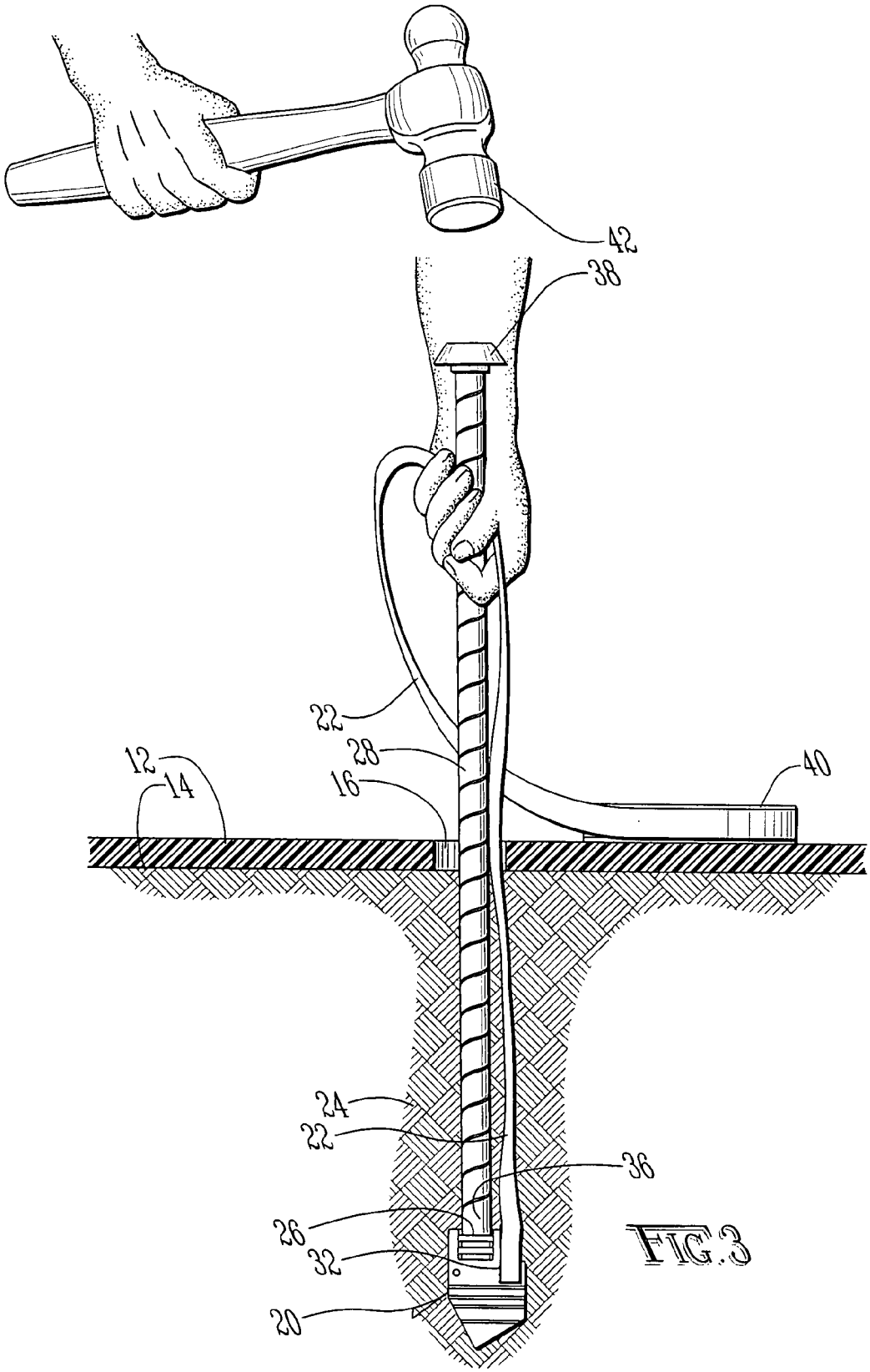
FIG. 3 illustrates a side elevation in partial cross-section of the driving rod positioning the anchor below the ground.
Figure 4:
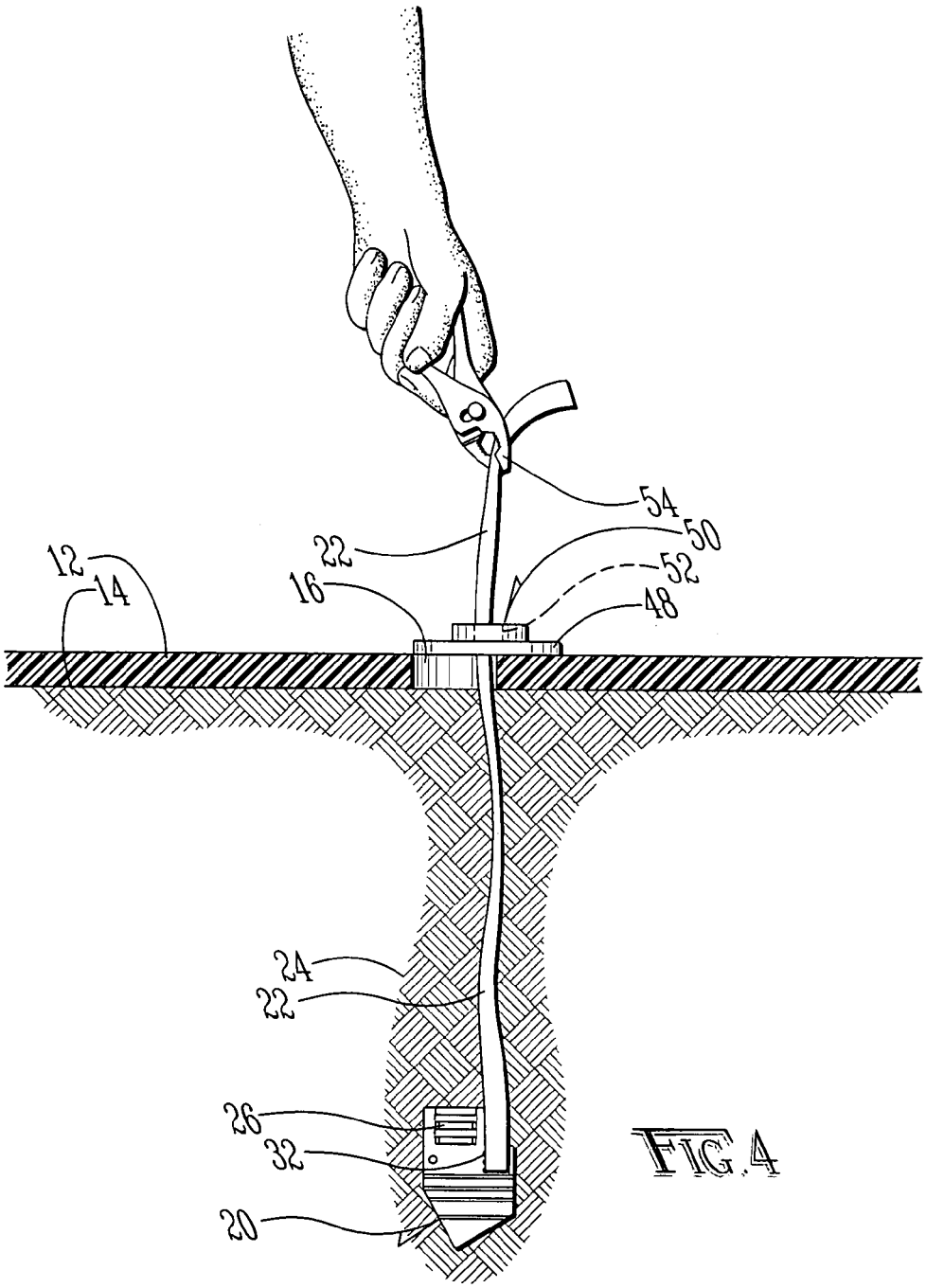
FIG. 4 illustrates a side elevation in partial cross-section of the anchor system of the present invention, shown securing an erosion control mat over an erosion susceptible surface.

As shown in FIG. 2, an anchor (20) is provided to secure a line such as a strap (22) into the ground (24). (FIGS. 2 and 3). As shown in FIG. 2, the anchor (20) is preferably stamped from a single sheet of steel to provide a tapered, four-sided structure. The anchor (20) is also preferably provided with holes (23) to allow the anchor (20) to be used in association with prior art cables (not shown) instead of the flat strap (22) of the present invention. While the anchor (20) may be constructed of any desired configuration, the tapered configuration allows the anchor (20) to be easily inserted into the ground (24), while reducing damage to the anchor (20) during insertion. Preferably, the anchor (20) is die cut and bent in a manner known in the art to provide a tapered retaining slot (26) to receive the driving rod (28). The slot (26) is defined by a plurality of ribs (30), but may be defined by an extra piece secured to the anchor (20), or may be integrally cast into the anchor (20) as desired.

As shown in FIG. 2, the anchor (20) is provided with a plurality of slots (32) to receive the strap (22) which is woven therein. The slots (32) are preferably provided of a size, configuration and orientation so as to lock the strap (22) into place as the anchor (20) is inserted into the ground (24) by the driving rod (28). Below the slots (32) the anchor (20) is preferably stamped into a corrugation (34), so as to disrupt the ground (24) as the anchor (20) is inserted therein. The corrugation (34) prevents the ground (24) from shearing the strap (22) against the sides of the slots (32). The strap (22) is preferably flexible and resilient. In the preferred embodiment, the strap is constructed of woven nylon, fiberglass or any other suitable material known in the art. Preferably, the strap (22) is treated and/or constructed of a material designed to resist degradation associated with ultraviolet radiation, heat, cold and submersion in water, as well as any other elements to which the system (10) is to be subjected.

When it is desired to insert the anchor (20) into the ground, the driving rod (28) is secured into the slot (26) defined by the ribs (30). The ribs (30) are vertically offset from the slots (32) so that the strap (22) does not interfere with the driving rod (28) during insertion of the anchor (20). Preferably, the driving rod (28) is constructed of steel and provided with a tapered end (36), configured to fit into a mating engagement with the slot (26). The opposite end of the driving rod (28) is preferably provided with a head (38) to provide a striking surface during insertion of the driving rod (28) into the ground (24). (FIG. 3). Once the strap (22) has been woven into the slots (32) of the anchor (20), and the driving rod (28) secured within the slot (26), the erosion control mat (12) is positioned as desired over the erosion susceptible surface (14). Thereafter, the driving rod (28) is used to insert the anchor (20) through one of the holes (16) in the erosion control mat (12) and into the ground (24).

Depending upon the type of ground (24) into which the anchor (20) is to be inserted, the driving rod (28) is used to insert the anchor (20) deeper or shallower so as to attain the desired anchoring of the erosion control mat (12) relative to the erosion susceptible surface (14). In very hard ground (24), the anchor (20) may be inserted shallow, while in loose dirt or sand the anchor (20) must be provided more deeply to obtain a similar amount of anchoring. The strap (22) is preferably provided on a spool (40) to allow the desired amount of strap (22) to be inserted into the ground (24) with minimal waste. To assist in driving the anchor (20) into the ground, a hammer (42) or the like may be used to strike the driving rod (28) on the head (38).

Once the driving rod (28) has been used to drive the anchor (20) to the desired depth, the driving rod (28) is pulled upward. As the top surface (44) of the anchor (20) is provided with a much greater surface area than the bottom (46) of the anchor (20), the anchor (20) inserts easily into the ground (24), but resists upward movement of the anchor (20) relative to the ground (24). Accordingly, as the driving rod (28) is pulled upward, the tapered end (36) of the driving rod (28) exits the slot (26), leaving the anchor (20) imbedded into the ground (24). After the driving rod (28) has been removed, the strap (22) is pulled upward to "set" the anchor (20) into the ground (24). Once the anchor (20) has been set, the strap (22) is cut, preferably ten to twenty centimeters above the top of the erosion control mat (12). Thereafter, a washer (48), such as those known in the art, is positioned over the strap (22) and set on the erosion control mat (12). Preferably, the washer (48) is constructed of nylon or other strong weather resistant material and is preferably provided of a diameter greater than the hole (16) through which the strap (22) extends.

A one-way button (50) is then provided over the strap (22) and secured over the washer (48). Preferably, the one-way button (50) is provided of a weather resistant material. The button (50) is provided with an opening (52) having a one-way mechanism, such as those known in the art, to allow the strap (22) to move in a first direction, but which prevents movement of the strap (22) in an opposite direction through the opening (52). To set the button (50) in place, the strap (22) is preferably pulled upward with pliers (54), or the like, while the button (50) is pushed downward. By stretching the strap (22) with the pliers (54), when the button (50) is in place and the pliers (54) released, the resiliency of the strap (22) pulls against the one-way button (50), forcing the erosion control mat (12) into contact with the erosion susceptible surface (14). As shown in FIG. 1, preferably a plurality of anchor systems (10) are provided as desired to secure the erosion control mats (12) as needed.

Figure 5:
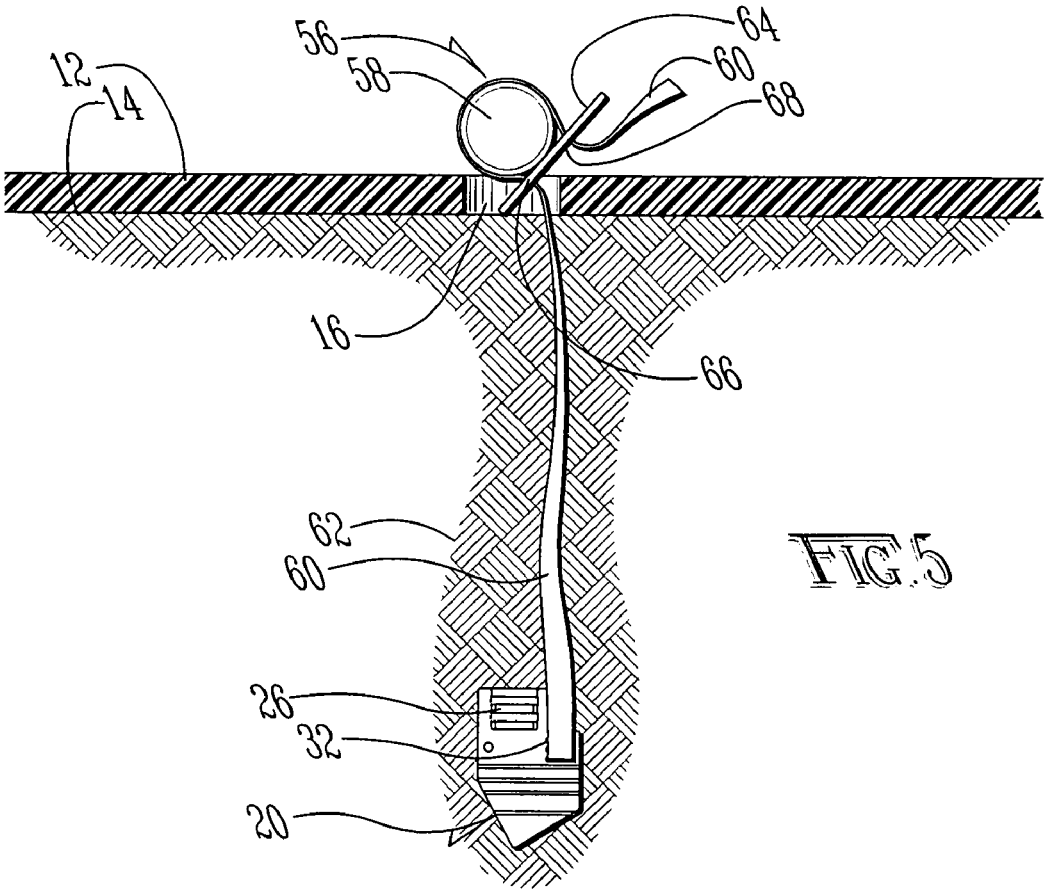
FIG. 5 illustrates a side elevation in partial cross-section of an alternative embodiment of the present invention, shown locking the strap around a portion of the erosion control mat.

FIG. 5 shows an alternative embodiment of the present invention in which the erosion control mat (56) is provided with a support bar (58) having a circular cross-section. The support bar (58) may be integrally formed as part of the erosion control mat (56), or may otherwise be secured to the erosion control mat (56). As shown in FIG. 5, the strap (60) is anchored into the ground (62) in a manner such as that described above for the preferred embodiment. A button (64) is then provided with two slots (66) and (68). Although one or both of the slots (66) and (68) may be of a one-way construction such as that noted above, in the preferred embodiment both of the slots (66) and (68) are provided of a one-way construction. Accordingly, the strap (60) is threaded through the first slot (66), around the support bar (58) and back through the second slot (68). The strap (60) is preferably secured by pulling on the strap (60) with pliers or other retention means to stretch the strap (60) so that when the pliers (not shown) are released, the resiliency of the strap (60) pulls the support bar (58) and erosion control mat (56) into the ground (62).

Figure 6:
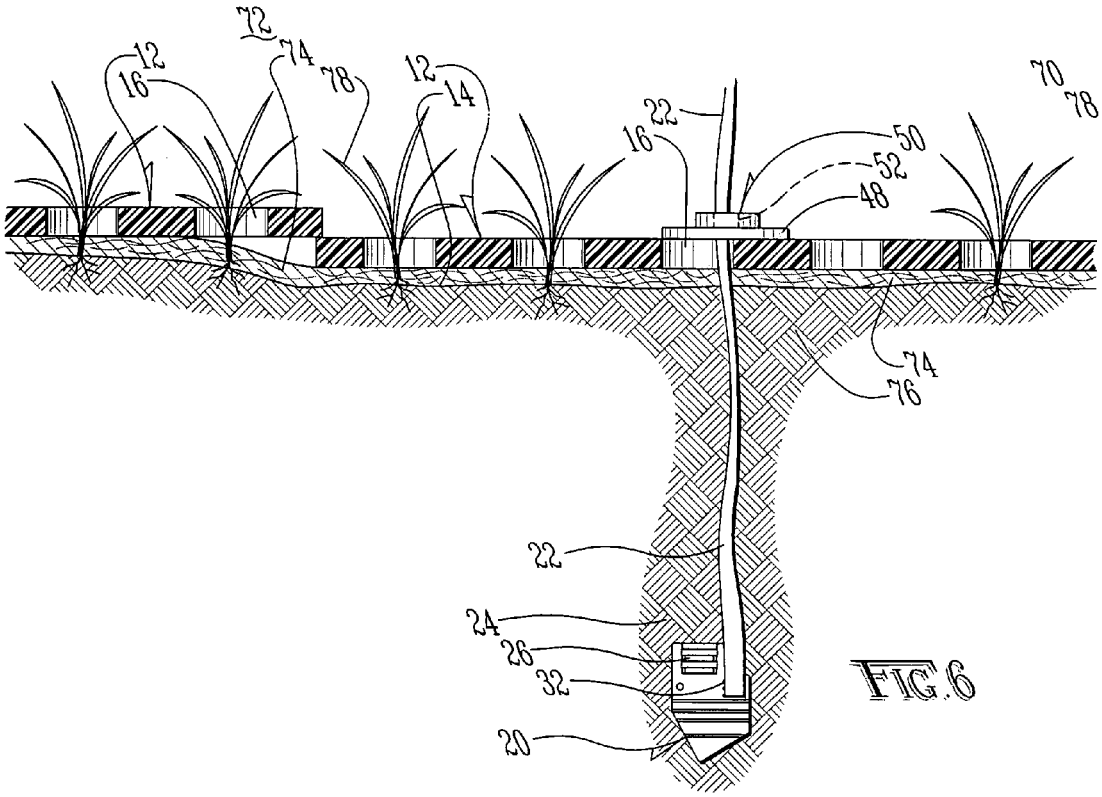
FIG. 6 illustrates a side elevation in partial cross-section of the anchor system securing a plurality of erosion control mats over sod in a drainage ditch.

FIG. 6 shows a plurality of erosion control mats (12) secured along the bed (70) of a drainage ditch (72). The erosion control mats (12) may be secured over turf reinforced mats (not shown), or may be secured over sod (74) provided over the soil (76). Alternatively, the soil (76) may be seeded and the grass allowed to grow through the holes (16) in the erosion control mats (12). The combination of the erosion control mats (12), with geotextile fabric (not shown), such as that known in the art, turf reinforcement mats (not shown) or vegetation, such as grass (78) over the soil (76), aids in the further reduction of soil erosion.

The erosion control mats (12) are secured using a plurality of anchor systems (10) in a manner Such as that described above. The erosion control mats (12) may be abutted to one another or they may be shingled in relationship to one another. Preferably, the anchor systems (I 0) extend at least five centimeters below the soil (76), and are provided in sufficient number and to a sufficient depth in the soil (76) to secure the erosion control mats (12) against heavy now of effluent, such as water (78), through the drainage ditch (72).

Figure 7:
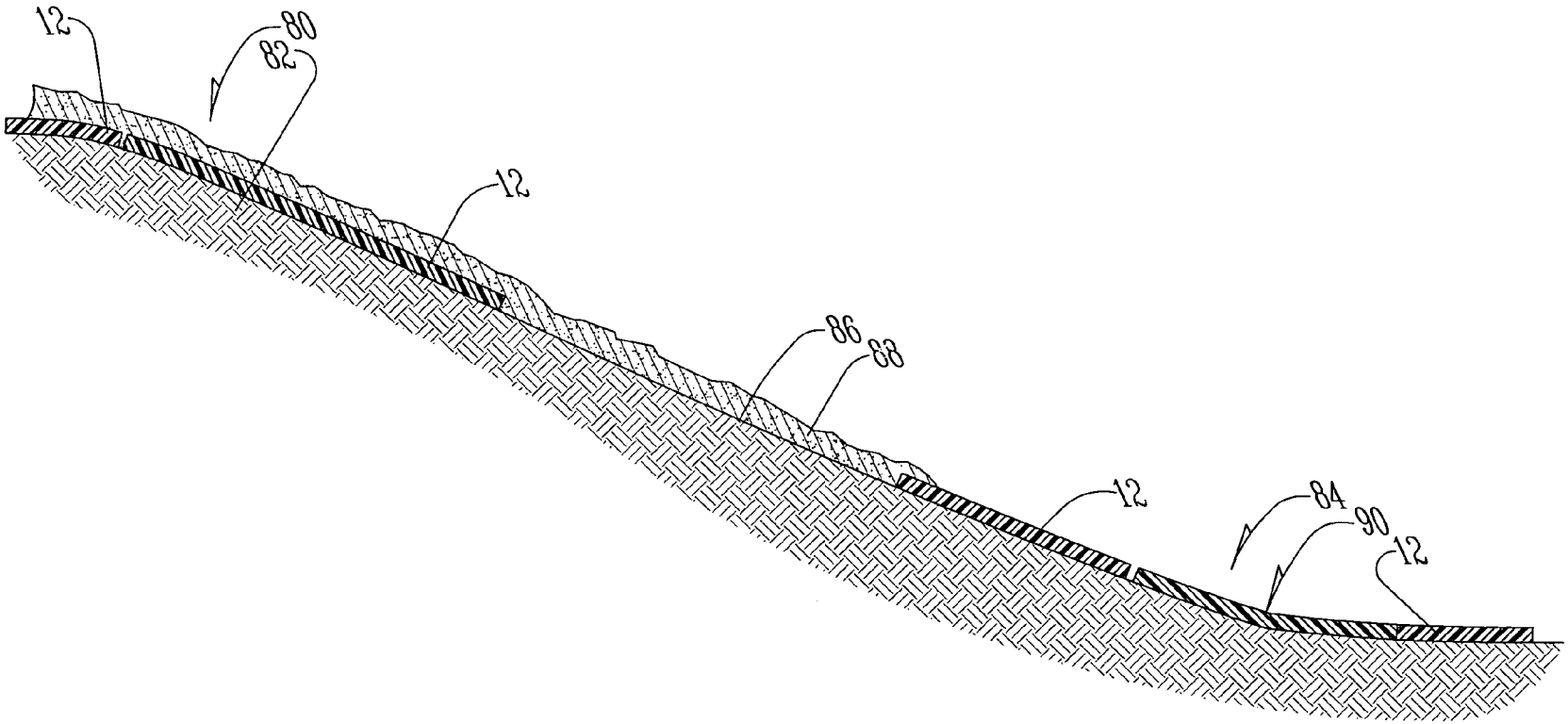
FIG. 7 illustrates a side elevation in cross section of the anchor system securing a plurality of erosion control mats in an overflow application.

FIG. 7 shows a plurality of erosion control mats (12) secured at the crest (80) of a retention embankment (82). Additional erosion control mats are secured at the bottom (84) of the runoff slope (86) to prevent overflow effluent (88) from eroding or "head cutting" the bottom (84) of the runoff slope (86). As shown in FIG. 7, multiple erosion control mats (12) may be anchored next to on another as shown at the crest (80) of the retention embankment (82) or an angled erosion control mat (90) may be used alone or in association with other erosion control mats (12) to accommodate the angled bottom (84) of the runoff slope (86).

The anchor systems (10) secure the erosion control mats (12) against water flows of at least one meter per second, preferably at least two meters per second and, most preferably, at least four meters per second over a time period of at least thirty minutes. The anchor systems (10) secure the erosion control mats (12) against flowing fluid pressures of at least two and one-half kilograms per square meter, preferably at least five kilograms per square meter and, most preferably, at least eight kilograms per square meter.

The foregoing description and drawings merely explain and illustrate the invention, and the invention is not limited thereto, except insofar as the claims are so limited, as those skilled in the art that have the disclosure before them will be able to make modifications and variations therein without departing from the scope of the invention. The anchor system (10) may, of course, be utilized with any desired strap (22) constructed of any suitable material, including, but not limited to, metal or rope. Similarly, any desired type of retainer may be utilized which allows the strap to move in a first direction relative to the retainer and prevents the strap from moving in a second direction relative to the retainer.

What is claimed is:

1. An erosion control system comprising:

an erosion control surface comprising a semi-rigid, planar mat defining a plurality of holes;

an erosion susceptible area;

a plurality of anchors for securing said surface over said erosion susceptible area against a fluid flow of at least two meters per second, said anchors including an enclosed retaining slot integrally cast into the anchor and of suitable dimensions to accept an end of a driving rod, and an elongated aperture configured to receive a flexible resilient strap said anchors coupled to a first end of the strap and a one-way catch coupled to a second end of the strap; and wherein said surface weighs less than one hundred kilograms.

2. The erosion control system of claim 1, wherein said surface is less than five centimeters thick.

3. The erosion control system of claim 1, wherein said surface defines an area less than five square meters.

4. The erosion control system of claim 1, wherein a two meter long section of said surface deflects less than forty-five degrees under its own weight when supported on one side.

5. The erosion control system of claim 1, wherein said surface is at least one centimeter thick.

6. The erosion control system of claim 1, wherein said surface weighs less than fifty kilograms.

7. The erosion control system of claim 1, wherein said holes are less than twenty-five centimeters in diameter.

8. The erosion control system of claim 1, wherein said strap is affixed to said anchor via said aperture.

9. The erosion control system of claim 1, wherein said anchor is provided at least five centimeters below said erosion susceptible surface.

10. The erosion control system of claim 1, wherein said anchor is coupled to said erosion control surface by affixing said strap to a support bar.

11. The erosion control system of claim 1, wherein said plurality of anchors are provided at least five centimeters below said erosion susceptible area and each anchor is coupled to said surface by each anchor's respective strap.

12. The erosion control system of claim 1, further comprising a fluid flow over said surface of at least two meters per second.

13. The erosion control system of claim 1, wherein said system secures said surface over said erosion susceptible area against a fluid shear of at least 2.5 kilograms per square meter.

14. The erosion control system of claim 1, wherein said system secures said surface over said erosion susceptible area against a fluid shear of at least 4.0 kilograms per square meter.

15. The erosion control system of claim 1, wherein said system secures said surface over said erosion susceptible area against a fluid flow of at least three meters per second.

16. The erosion control system of claim 1, wherein said system secures said surface over said erosion susceptible area against a fluid flow of at least four meters per second.

17. An erosion control system comprising:

a semi-rigid, planar erosion control surface defining a plurality of holes;

an erosion susceptible area;

a plurality of anchors for securing said surface over said erosion susceptible area against a fluid flow of at least two meters per second, each of said plurality of anchors including an at least partially enclosed retaining slot having suitable dimensions to accept an end of a driving rod, each of said anchors further including an elongated aperture configured to receive a flexible, resilient strap, wherein at least one of said plurality of anchors is provided at least five centimeters below a surface of said erosion susceptible area, and wherein said strap is stretched in tension between said anchor and said erosion control surface to bias said erosion control surface against said surface of said erosion susceptible area.

18. The erosion control system of claim 17, wherein said system secures said surface over said erosion susceptible area against a fluid flow of at least two meters per second for at least thirty minutes.

19. A method for reducing erosion comprising:

placing a rigid erosion control mat defining a plurality of holes on a ground surface of an erosion susceptible area;

inserting a first end of a driving rod into an at least partially enclosed retaining slot of an anchor;

inserting a first end of a flexible, resilient strap through an elongated aperture in said anchor to affix said first end of said strap to said anchor;

driving said anchor to a desired depth in said ground surface through one of said plurality of holes defined by said rigid erosion control mat by applying a force to a second end of said driving rod;

removing said first end of said driving rod from said retaining slot of said anchor;

inserting a second end of said strap in a one-way retaining button; or affixing said second end of said strap to a support bar; and applying tension to said strap between said anchor and said retaining button or said support bar to sufficiently secure said erosion control mat against said ground surface to withstand movement of said erosion control mat when said erosion control mat is subjected to a fluid flow of at least two meters per second; and wherein said erosion control mat weighs less than one hundred kilograms.

20. The method for reducing erosion of claim 19, wherein said desired depth is at least five centimeters below said ground surface of said erosion susceptible area.

* * * * *